United States Patent [19]

Ramaekers

[11] Patent Number: 4,966,362

[45] Date of Patent: Oct. 30, 1990

[54] WHEELCHAIR EXERCISER ADAPTER

[76] Inventor: Donald B. Ramaekers, 9655 SW. Murdock St., Tigard, Oreg. 97224

[21] Appl. No.: 179,749

[22] Filed: Apr. 11, 1988

[51] Int. Cl.[5] ..... A63B 22/02

[52] U.S. Cl. ..... 272/93; 272/69; 272/73

[58] Field of Search ..... 272/69, 73, 93, 134; 280/289 WC; 73/117; 434/61

[56] References Cited

U.S. PATENT DOCUMENTS

| | | | |
|---|---|---|---|
| 642,919 | 2/1900 | Nott . | |
| 1,525,447 | 2/1925 | Hose | 73/117 |
| 2,702,432 | 2/1955 | Martin | 73/117 X |
| 3,411,346 | 11/1968 | Gagliardi | 73/117 |
| 4,233,844 | 11/1980 | Dreisinger et al. . | |
| 4,415,154 | 11/1983 | Smith | 434/61 X |
| 4,572,501 | 2/1986 | Durham et al. . | |
| 4,834,363 | 5/1989 | Sargeant et al. | 272/73 |
| 4,846,156 | 7/1989 | Kopnicky | 272/134 X |

FOREIGN PATENT DOCUMENTS

| | | | |
|---|---|---|---|
| 2833354 | 2/1980 | Fed. Rep. of Germany | 272/69 |
| 3304707 | 10/1983 | Fed. Rep. of Germany | 272/73 |
| 2534806 | 4/1984 | France . | |
| 2184361 | 6/1987 | United Kingdom | 272/69 |

OTHER PUBLICATIONS

Abstract (Basic) (in English): FR 2534806, File 351, World Patents Index, Derwent, Dialog 12/11/87.

"An Ergonomic Analysis of Wheelchairs"-R. L. Brauer, University of Illinois, Urbana/Champaign-1972. (Cited in 4,233,844 Dreisinger), Extract by B. J. Ffitch, 3/16/88.

*Primary Examiner*—V. Millin
*Assistant Examiner*—D. F. Crosby
*Attorney, Agent, or Firm*—Bruce J. Ffitch

[57] ABSTRACT

A shallow rectangular frame supports a pair of free-running elongated rollers parallel to each other and spaced suitably to cradle the main wheels of a conventional wheelchair. A gentle ramp ahead of the rollers enables a wheelchair occupant to drive the wheelchair backwards up the ramp and roll the wheels into the roller cradle. A transverse backstop guards against overrunning the cradle. With the main wheels of the wheelchair in the roller cradle, the front wheels of the chair are supported by the ramp. An adjustable brake at the front roller provides for variable exercising effort and also brakes or locks the roller so that the chair may be easily driven out of the roller cradle and down the ramp.

19 Claims, 2 Drawing Sheets

WHEELCHAIR EXERCISER ADAPTER

BACKGROUND OF THE INVENTION

The invention concerns a device for adapting a conventional wheelchair for use as a stationary exerciser, and more particularly a device facilitating exercise of arms and upper body which requires no modifications of or attachment to the wheelchair.

Forward extensions of wheelchairs have been proposed to facilitate various forms of exercise or therapeutic activity for their occupants. See for example, U.S. Pat. Nos. 3,405,954 Wolfe; 3,423,086 Moore, and 4,572,501 Durham. Durham does provide for arm exercising but all three in effect require forward extension of the chairs and include ground engaging wheels or support stands.

"Exercise bicycles" are well known. The field may include devices for adapting standard bicycles for stationary exercise—see for example, U.S. Pat. No. 642,919 Knott which discloses a double roller treadmill arrangement for supporting a bicycle's back wheel. The rotation of the rollers may be "braked" to demand more effort from the rider. In another arrangement the bicycle rear frame is supported on a stand so that the rear wheel is free to rotate and its rotation may be variably braked. The common feature of these two examples is that a conventional vehicle is used essentially "as is", without significant modification. As far as bicycle and rider are concerned the stationary operation of the bicycle reproduces very closely its normal operation.

Wheelchairs have been mounted on treadmill-like roller arrangements in ergometric studies. See for example, the work of Brauer, reported in U.S. Pat. No. 4,233,844 Dreisinger. (Dreisinger himself discloses a wheelchair ergometer in which the wheelchair is supported above the ground by its frame rather than its wheels, and energy absorbing means are connected to extensions of the wheelchair axles). As reported by Dreisinger, Brauer's arrangement included two pairs of rollers for receiving the wheels of the wheelchair, with braking or clutching means for at least one of the rollers. According to Dreisinger, Brauer's device was relatively expensive and it was necessary to wheel the wheelchair and subject up an incline and into position on the rollers for measurements to be made.

The arrangement disclosed by Brauer himself ("An Ergonomic Analysis of Wheelchairs", R. L. Brauer, U. of Illionois, 1972) includes closely spaced rollers for supporting the main wheels of the chair while the castering wheels are each supported in short, vertically adjustable channel members.

Dreisinger also refers to a floor mounted motor driven treadmill providing for the use of a standard wheelchair but comments that "it can be quite expensive to install and maintain and provides a possibility of mishap should the subject either fail to keep up with the treadmill or unexpectedly leave the treadmill during an experiment or exercise bout, if no restraining chains were provided."

Dreisinger also comments, writing apparently in 1978, that most of the studies conducted in the area of physical training programs for the handicapped have concluded that there is little benefit to a systematic training program, in improving the physical condition of the handicapped. As a result little work had been done to develop and improve physical exercise equipment for them, and much of the equipment available was developed for use in scientific studies rather than for recreational or exercise use by individuals.

Regardless of Dreisinger's conclusions, at least one more recent attempt has been made to provide an acceptable exercise device for use with wheelchairs for rehabilitation, sports training, or in the home as a muscle toner—see French Patent No. 2,534,806 Jeanmot, filed in 1982. Jeanmot's quite complicated device includes two pairs of rollers, one set for the main wheels and one set for the front or stabilizing wheels of the wheelchair. The two innermost rollers are connected by drive belts, and one of the rollers is braked. There is a ramp at the back to assist in elevating the wheelchair to the level of the rollers. Screw mechanisms at each end of the frame permit leveling adjustment to simulate slopes. The wheelchair frame is secured to the device by means of a telescopic hold down system. Jeanmot appears to suggest that the wheelchair occupant can propel the chair into position on the rollers unassisted, but his ramp appears steep and he does not explain how the relatively small front castering wheels of the wheelchair can safely or comfortably be navigated across the relatively large gap between the main wheel rollers (13 and 14), and the even larger gap between rollers 14 and 15, before reaching their resting place between rollers 15 and 16. (If, as is conventional, the wheelchair's front wheels are freely castering the risk of mishap appears high. Note also that the horizontal spacing between the two sets of rollers must be adjusted to suit the corresponding spacing between the front wheels and the drive wheels of the particular wheelchair). Jeanmot's device by its size, complexity, and apparently heavy weight appears most suitable for institutional use, or at least in a home large enough to have space available for dedication to its use.

SUMMARY OF THE INVENTION

Accordingly it is an object of the invention to provide a stationary wheelchair exerciser adapter, which enables a wheelchair occupant to perform useful and satisfying exercise without requiring modifications of, or attachments to the wheelchair, and which requires no attached safety restraint when the chair is in position on the device.

A further object of the invention is to provide a device which is simple, compact, light in weight and which may be used and managed and handled by a person confined to a wheelchair entirely without assistance. The regular occupant-powered propulsion system of the chair should be operable and operative in the same way as when the chair is mobile and in normal use.

It is a feature of the device that the wheelchair occupant may propel himself and chair into position on the device comfortably and safely, without outside assistance.

These and other objects may be achieved in a wheelchair exerciser adapter which consists essentially of a low flat frame, which may be rectangular, for being supported on a substantially level floor and carrying a pair of relatively small diameter rollers, freely rotating and suitably spaced for rotatably cradling the drive wheels of a wheelchair closely above the floor, and a gently sloping ramp serving to deliver the drive wheels of the chair to the "cradle" of the rollers when the chair is propelled rearwardly up the ramp by the occupant. Frame, rollers and ramp may preferably be dimensioned so that when the chair is in position, with the drive wheels supported by the rollers, the front or guide wheels of the chair are supported by the ramp and so that the chair is substantially level. Preferably dimensions are such also that the overall length of the frame and of the chair are approximately equal and so that the chair substantially overlies the frame when in use on the adapter.

In preferred embodiments, a relatively low safety or stop rail may be supported above the rear or back end of the frame on the opposite side of the pair of rollers from the ramp to guard against inadvertent overrunning of the roller cradle by the main or drive wheels of the chair.

The adapter also preferably includes anti-friction means effective adjacent the roller ends for contacting the drive wheels of the chair and limiting its range of side drift on the rollers when in use.

Also in a preferred embodiment, one of the rollers may be braked to vary the propulsion effort required of the occupant. When the braked roller is the roller adjacent the top of the ramp its braking may provide a frictional force and hence necessary traction for delivering the drive wheels from the ramp into the cradle, or from the cradle back to the ramp when exercising is over.

It is an advantage of a wheelchair exerciser adapter according to the invention, that its self-contained simplicity and compactness have the potential for a attractively light weight and low cost compared with other known wheelchair exercising devices. Light weight and compactness mean portability and easy storage. Less floor space is needed and in some cases a handicapped person can set up the device and use it completely independently. These features and advantages make the adapter widely useful. For example, a convalescent, after bed confinement, can gently begin to restore muscle tone, at least in arms and upper body, even though his general activities are still severely restricted. And a handicapped person can maintain an exercise regime even though weather or other circumstances keeps him indoors.

DESCRIPTION OF THE PREFERRED EMBODIMENT

Figure 1:
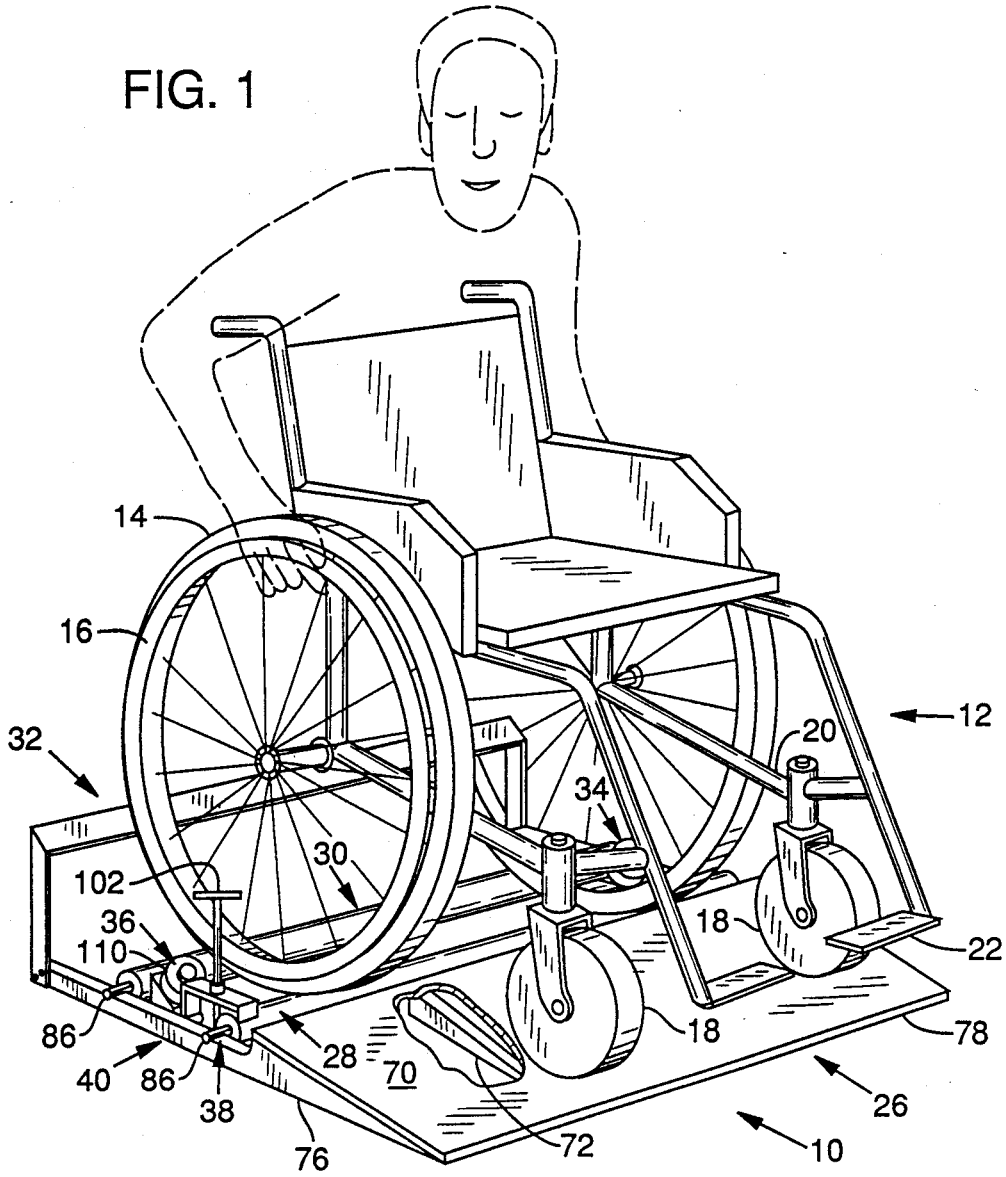
FIG. 1 is a right front perspective view of a wheelchair exerciser adapter according to the invention with a wheelchair and occupant in position and ready for exercise on the adapter.
Figure 3:
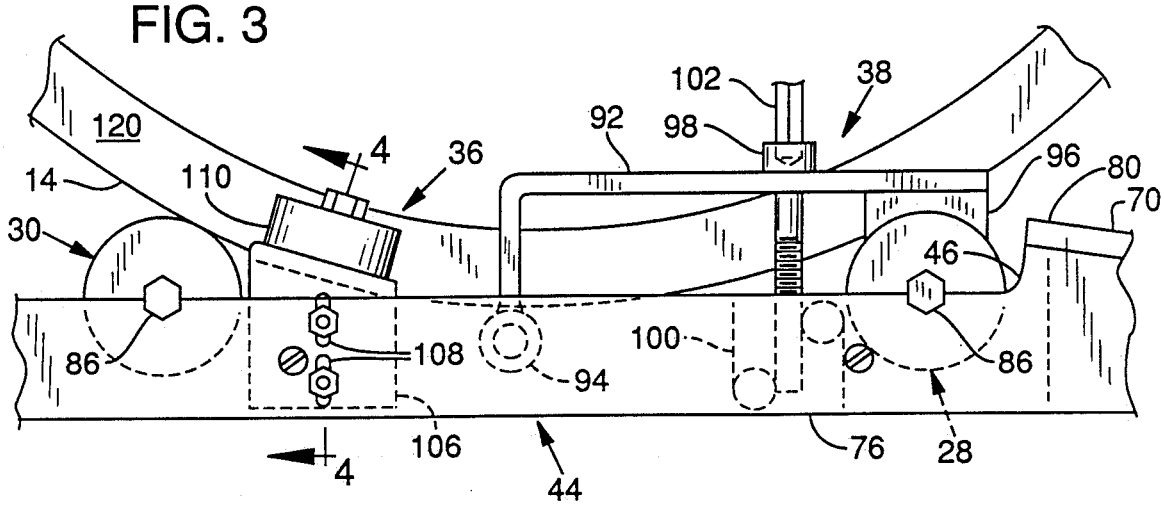
FIG. 3 is an enlarged partial side view similar to FIG. 2 showing details of the braking arrangement for the front roller and of one of the roller guides for limiting sideways drift of the wheelchair on the support rollers.

The invention is embodied in the wheelchair exerciser adapter 10 shown in FIG. 1 with a wheelchair 12 and occupant in position for exercising operation on the adapter.

The adapter 10 is designed for use with generally conventional wheelchairs such as the very common type of handrim drive wheelchair illustrated. Main or drive wheels 14 carry a concentric drive rim 16, somewhat smaller in diameter than the drive wheels 14 but located conveniently for grasping and pushing or pulling by the wheelchair occupant so as to propel and maneuver the chair. Front wheels 18 of much smaller diameter caster to assist in steering and maneuverability. The frame 20 of the chair extends forward to carry a pair of foot rests 22. Note that the exerciser adapter is also compatible with other forms of occupant-powered propulsion systems and with minor variations in configuration such as having a single front stabilizing wheel. The degree of standardization of wheelchairs is such that one size of exerciser adapter may accommodate many different chairs without requiring adjustment.

Important functional elements of the exerciser adapter 10 include an access and support ramp 26; drive wheel support rollers 28 front and 30 rear; a safety back stop 32; side drift limiting guide roller assemblies 34 left hand and 36 right hand; and a roller braking assembly 38 for variably braking the front roller 28. (Left and right hand, front and rear, are as perceived by a wheelchair occupant in position on the adapter.)

Looking now at some details of the structure of the exerciser adapter 10—its main frame 40 consist of elongated wooden side rails, left and right hand 42, 44, respectively with an upward step 46 about halfway along their length, and relatively gently tapered front ends 48, 49. The rear portions 50, 52 of the wood rails are reinforced by left and right hand steel rails, 54, 56 respectively fastened to the inside surfaces of the wood rails 42, 44. They extend forward about half the lenght of the wood side rails and include rearward projections 58, 60, respectively. These projections or extensions carry rigidly attached uprights 62, 64 which support an elevated transverse backstop rail 66. The uprights 62, 64 and the rail 66 make up the back stop assembly 32.

The access ramp 26 is formed by the forward tapered portions 48, 49 of the wooden side rails supporting a ramp floor 70, reinforced by intermediate supports 72 (indicated only in FIG. 1). The floor slopes gently from a bottom or front end 74 (at which there is a thin edge 78) to a rear or upper end 80.

In the exemplary embodiment disclosed here materials used in the exerciser adapter are principally wood and steel. But other materials such as plastics may be successfully used.

The structure of the rollers 28, 30 is generally conventional. Their form may be similar to that of a conveyor roller. In each a roller body 84 is journaled on a roller spindle 86 by anti-friction bearings not shown in the drawings. The rollers 28, 30 are secured to the main frame side rails 42, 44 by conventional hardware such as the screws 88 shown.

In the brake assembly 38, a brake arm 92 is pivoted to the main frame at pivot 94. The arm carries a shoe 96 which by means of a socket head screw 98 and a nut 100 may be variably biased against the front roller 28. A T-handled wrench 102 (shown in FIG. 1) is provided for manual adjustment of the screw 98.

The side mounted guide roller assemblies 34 and 36 are similar but the right hand assembly 36 is offset inwardly to maintain clearance between the right hand wheel 14, of the wheelchair and the roller brake assembly 38. Both assemblies include mounting brackets 104, 106, respectively which are vertically adjustable by means of slots 108, and each carries a free running roller 110. The brackets 104, 106 are angled so that the rollers 110 are approximately tangential to the wheels 14 at their point of contact.

Figure 5:
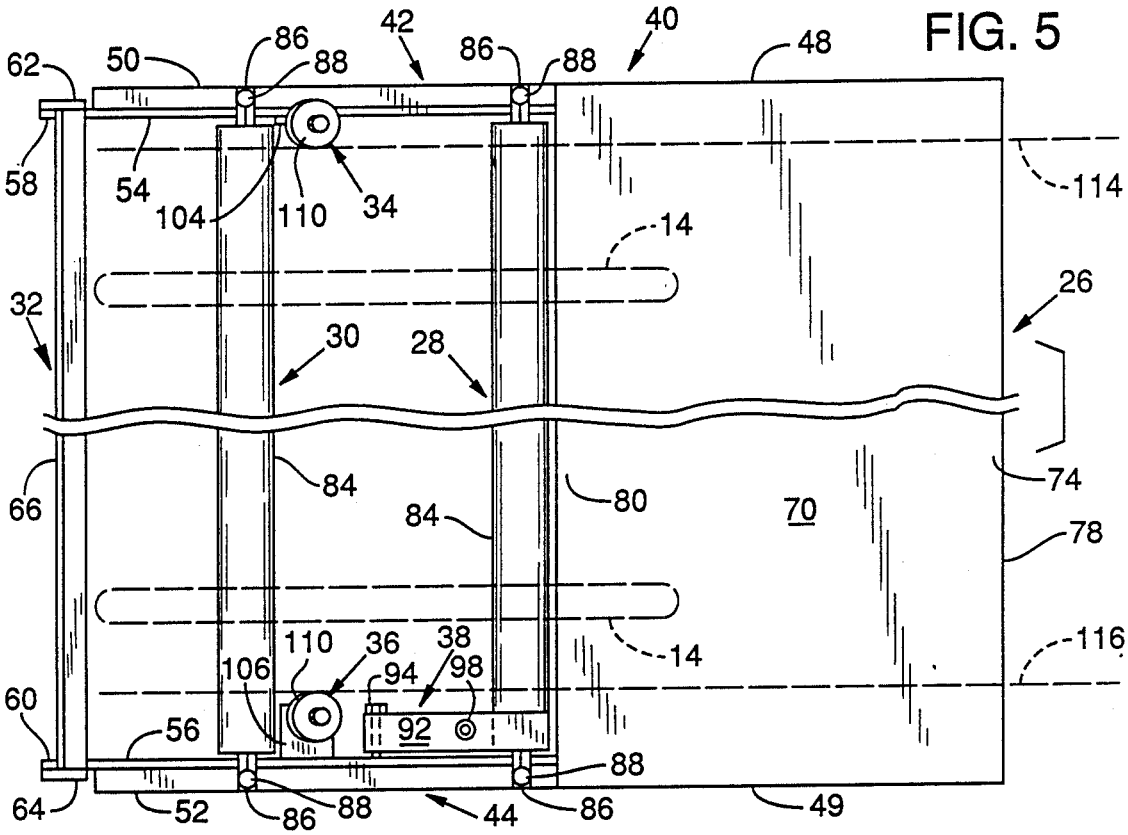
FIG. 5 is an overhead view of the exerciser adapter, with wheelchair wheels in typical operating position on the support rollers shown in phantom outline.

In typical operation, the exerciser adapter may first be removed from a convenient upright storage location and placed flat on a floor. The smooth flat bottom side 76 of the frame 40 is unlikely to mar floor surfaces or damage carpets. The wheelchair is next maneuvered by its occupant into a mounting position, backed up towards the edge 78 of the ramp 26. The chair should be approximately centrally placed with regard to the adapter or at least with its respective wheels 14 spaced a comfortable distance from either of the limits of lateral drift indicated in FIG. 5 by the broken lines 114, 116. The thinness of the edge 78 at the bottom end of the ramp, and the gentle slope of the floor 70 make it easy for a wheelchair occupant under his own power to back the wheelchair up the ramp so that the wheels 14 roll easily over the top end 80 of the ramp and the front roller 28 and into the cradle defined by the roller bodies 84. To help minimize the slope of the ramp 26 the roller bodies 84 may be of relatively small diameter (for example, about 2 inches OD) and mounted only so high above the frame bottom 76 that they have sufficient running clearance with the floor or floor covering beneath them when in use. As may be seen best in FIG. 2, the plane of the ramp floor 70 extended, is approximately tangential to an upper portion of the body 84 of the forward roller assembly 28. For ease and safety of mounting onto the adapter, the floor 70 should not pass below the axis of rotation of the front roller assembly 28 so as to make the transit from the ramp into the roller cradle as smooth as possible. Preferably the floor 70 is more nearly tangential to the upper side of the roller.

Figure 2:
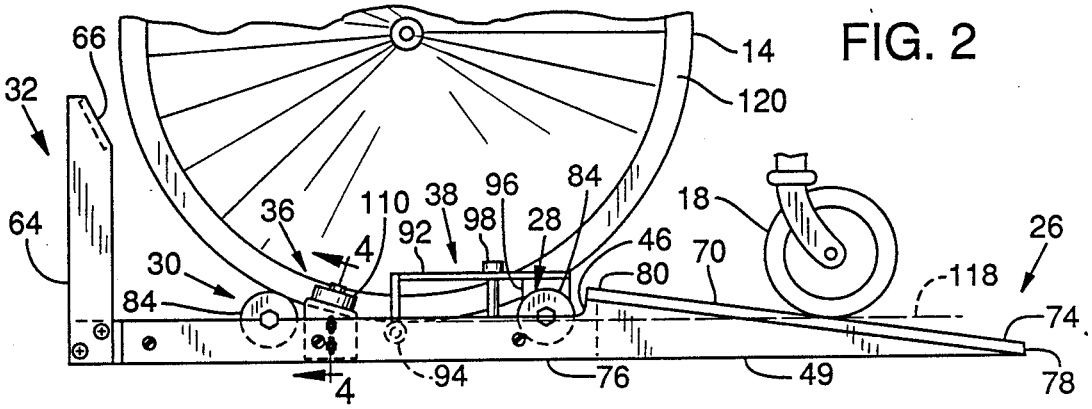
FIG. 2 is a right side view of the adapter with a wheelchair (shown only partially) in position for exercising operation.
Figure 4:
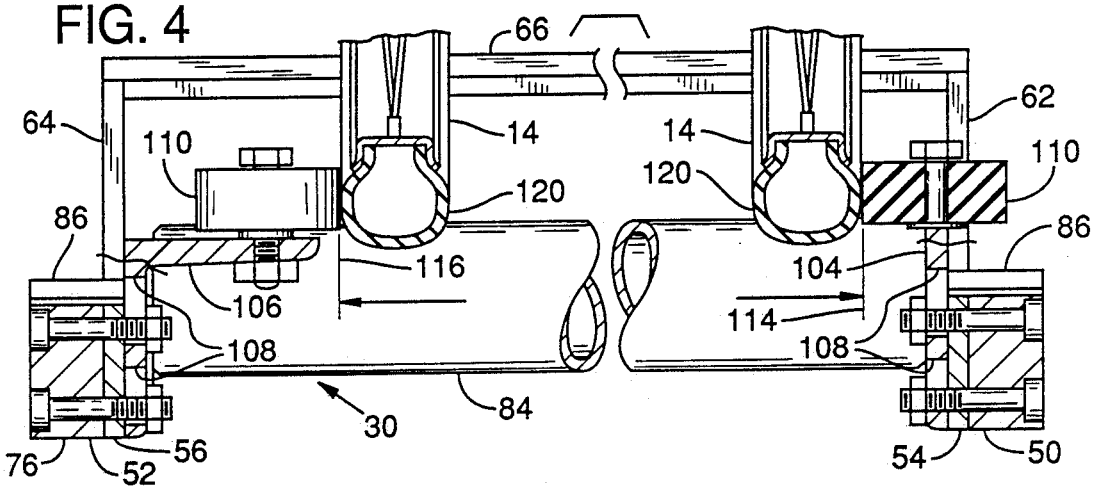
FIG. 4 is a cross sectional view taken approximately on line 4—4 of FIG. 3 showing the guide roller arrangement for limiting sideways drift of the wheelchair on the support rollers.

When the main wheels 14 of the wheelchair are supported or cradled by the rollers, the front wheels 18 of the chair are, as seen best in FIGS. 1 and 2, supported by an intermediate portion of the floor 70 of the access ramp 26. As indicated by the level line 118 in FIG. 2, when the wheelchair is in position on the adapter, it is supported substantially level fore and aft, assuming the adapter main frame bottom side 76 is sitting on a level floor. (This is an important comfort factor). The position of the front wheels on the ramp is not predetermined and clearly an adapter according to the invention may accommodate wheelchairs which vary in spacing between front and rear wheels. An adjustable front wheel support is not required.

If the wheelchair is driven onto the adapter with excessive speed, so that it tends to roll on through the cradle of the rollers, then the wheels 14 are safely arrested by their engagement of the backstop rail 66. As seen best in FIG. 2, the rail 66 is angled so that when in stopping contact with a wheel its surface is approximately tangential, presenting a smooth surface to the tire 120 and minimizing the possibility of the wheel 14 climbing the rail 66.

With the chair in position on the adapter and as shown in FIG. 1, the occupant is free to drive the wheels of the chair in the normal way by pulling or pushing on the hand rims 16, and so obtain valuable and satisfying exercise. Any drifting of the chair sideways on the rollers during an exercise session is limited by the tires 120 of wheels 14 coming into direct contact with one of the rollers 110 of the guide assemblies 34, 36. The rollers 110 are preferably free running and tangentially aligned so that contact with them adds little to the effort required to turn the wheels of the chair. The wheelchair occupant soon learns how, by applying unequal effort to the wheels, to control the lateral drift or, as it were, steer the chair on the rollers, so that if desired it may be maintained in an approximately central position.

The basic effort required to turn the wheels, and hence the toughness of the exercise session may be increased by manipulating the wrench 102 to increase the pressure of the brake shoe 96 on the body 84 of the front roller. As can be seen in FIG. 1, the wrench is in comfortable reach of the wheelchair occupant.

As can be seen from the drawings, the rollers 28, 30 are relatively widely spaced so that, for example, the angle between radial lines from the center of a wheel 14 to the rollers may be about 45 degrees and preferably not less than 30 degrees. Such a spacing ensures that rolling resistance of the wheels may be varied over a relatively wide range with the wheels remaining stably in their cradle. With closer spacings (as disclosed by Jeanmot and Brauer) the complication of a restraint may be needed to prevent the chair from rolling prematurely off the rollers. However in setting the roll spacing a balance must be maintained between achievable rolling resistance range and stability in the cradle of the rollers with a reasonable effort for exiting the chair from the adaptor by propelling it forward over a restrained front roller.

When the occupant is ready to dismount from the exerciser adapter, brake pressure on the front roller is increased using the wrench 102, so that when the wheels are driven in the forward driving direction, the roller no longer turns and the occupant smoothly drives or propels the wheelchair from the cradle, and down the ramp to the adjacent floor.

The compactness of the wheelchair exerciser adapter is clearly seen in FIGS. 1 and 2 where it may be noted that the overall length of wheelchair and adapter are approximately equal, and that, in position on the adapter, the wheelchair substantially overlays the adapter. In use therefore, the adapter requires no more space than the wheelchair alone and when not in use it occupies only moderate storage space. The back stop assembly 32 may be so angled with respect to the side rails 42, 44 so that the adapter may be stored standing upright and resting on the back stop assembly. To assist in portability of the adapter, a hand hole or handle may be provided in or under the ramp (not shown in the drawings).

Their compactness and simplicity mean that any adapters constructed according to the invention may be light in weight and easily handled, making it feasible for some wheelchair occupants unassisted to bring the adapter out of storage, move it to the desired exercise area and place it in position on a floor. With its low elevation, single set of rollers leaving the chair's front wheels securely on the ramp, and drive wheel stop (32), the design is inherently safe. Thus the disabled person is free to take exercise when desired, independently and without anxiety.

What is claimed is:

1. A wheelchair exerciser adapter for use with a wheelchair, the wheelchair having a pair of rear drive wheels, coaxial and spaced apart, and drivable by effort of a wheelchair occupant for propelling the wheelchair, and at least one forward stabilizing wheel, said wheel being significantly smaller than the drive wheels, comprising:

a generally flat frame having a bottom side for supporting the frame above a floor;

first and second elongated rollers rotatably supported athwart the frame, lying parallel to each other and spaced apart so as to define a cradle for receiving the drive wheels of the wheelchair; and a ramp carried by the frame outside the cradle and having a gently sloping upper surface extending from a lower end disposed in a plane adjacent the plane of the bottom side of the frame to an upper end disposed adjacent the first roller, whereby the wheelchair drive wheels may roll directly from the upper end of the ramp onto the first roller, the rollers and ramp being disposed so that, when the drive wheels of a wheelchair are cradled by the rollers and the front of the wheelchair is towards the ramp, the at least one forward wheel of the wheelchair is supported by the ramp and wherein the overall length of the exerciser adapter is approximately equal to the overall length of a wheelchair.

2. The exerciser adapter of claim 1 wherein, when the frame is supported on a level floor and a wheelchair is positioned on the adapter with its at least one front wheel and drive wheels respectively on the ramp and cradled by the rollers, the wheelchair is supported approximately level fore and aft by the exerciser adapter.

3. The exerciser adapter of claim 1 wherein the upper surface of the ramp lies substantially in an inclined plane, said plane passing through the first roller above approximately the rotational axis of the roller.

4. The exerciser adapter of claim 1 wherein the upper surface of the ramp lies substantially in an inclined plane and said plane passes above the rotational axis of the first roller, substantially tangential to the first roller.

5. The exercise adapter of claim 1 and including means carried by the frame and engageable with one of the rollers and controllable by the wheelchair occupant for applying a variable resistance to the rotation of said one of the rollers.

6. The exerciser adapter of claim 5 wherein the controllable means is effective on the first roller.

7. The exercise adapter of claim 1 and including means carried by the frame for limiting the lateral movement of a wheelchair when supported by the exerciser adapter, said means including opposing stop surfaces inset from the opposite ends of the rollers.

8. The exerciser adapter of claim 7 wherein the means for limiting lateral movement of a wheelchair includes a pair of laterally spaced apart rotatable guide members engageable by the wheels of the wheelchair.

9. The exerciser adapter of claim 1 and including a transversely extending safety stop carried by the frame and disposed outside of and elevated with respect to the cradle defined by the rollers and on the same side of the cradle as the second roller and disposed to be engageable by the drive wheels of a wheelchair so as to stop motion of the wheelchair, should the wheels move beyond the cradle in the direction of the safety stop.

10. The exerciser adapter of claim 1 wherein the length of the ramp is approximately equal to half the overall length of the exerciser adapter.

11. The exerciser adapter of claim 1 wherein, when the drive wheels of a wheelchair are cradled by the rollers, the spacing between the rollers subtends an angle at the rotational axis of the wheels, and said angle is not less than about 30 degrees.

12. The exerciser adapter of claim 1 wherein the ramp is integral with the frame.

13. A wheelchair exerciser adapter for use with a wheelchair, the wheelchair having a pair of rear drive wheels, coaxial and spaced apart, and drivable by effort of a wheelchair occupant for propelling the wheelchair, and at least one forward stabilizing wheel, said wheel being significantly smaller than the drive wheels, consisting essentially of:

a generally flat frame having a bottom side for supporting the frame above a floor;

first and second elongated rollers rotatably supported athwart the frame, lying parallel to each other and spaced apart so as to define a cradle for receiving the drive wheels of the wheelchair; and a ramp integral with the frame and disposed outside the cradle having a gently sloping upper surface extending from a lower end disposed in a plane adjacent the plane of the bottom side of the frame to an upper end disposed adjacent the first roller whereby the wheelchair drive wheels may roll directly from the upper end of the ramp onto the first roller and wherein the rollers and ramp are disposed so that, when the drive wheels of a wheelchair are cradled by the rollers and the front of the wheelchair is towards the ramp, the at least one forward wheel of the wheelchair is supported by the ramp and wherein the overall length of the exerciser adapter is approximately equal to the overall length of a wheelchair.

14. The exerciser adapter of claim 13 including means carried by the frame and engageable with one of the rollers and controllable by the wheelchair occupant for applying a variable resistance to the rotation of said one of the rollers.

15. The exerciser adapter of claim 14 wherein the controllable means is effective on the first roller.

16. The exerciser adapter of claim 13 and including means carried by the frame for limiting the lateral movement of a wheelchair when supported by the exerciser adapter, said means including opposing stop surfaces inset from the opposite ends of the rollers.

17. The exerciser adapter of claim 16 wherein the means for limiting lateral movement of a wheelchair includes a pair of laterally spaced apart rotatable guide members engageable by the wheels of the wheelchair.

18. The exerciser adapter of claim 13 and including a transversely extending safety stop carried by the frame and disposed outside of and elevated with respect to the cradle defined by the rollers, and on the same side of the cradle as the second roller and disposed to be engageable by the drive wheels of a wheelchair so as to stop motion of the wheelchair, should the wheels move beyond the cradle in the direction of the safety stop.

19. The exerciser adapter of claim 13 wherein the length of the ramp is approximately equal to half the overall length of the exerciser adapter.

* * * * *